US007726783B2

(12) United States Patent
Nihei

(10) Patent No.: US 7,726,783 B2
(45) Date of Patent: Jun. 1, 2010

(54) LIQUID DISCHARGE APPARATUS

(75) Inventor: Yasukazu Nihei, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 261 days.

(21) Appl. No.: 12/047,592

(22) Filed: Mar. 13, 2008

(65) Prior Publication Data

US 2008/0303876 A1 Dec. 11, 2008

(30) Foreign Application Priority Data

Mar. 16, 2007 (JP) ..... 2007-068357

(51) Int. Cl.
*B41J 2/045* (2006.01)

(52) U.S. Cl. ..... 347/70

(58) Field of Classification Search ..... 347/68–72; 400/124.14–124.16; 310/363–366
See application file for complete search history.

(56) References Cited

U.S. PATENT DOCUMENTS 7,244,016 B2 * 7/2007 Iwashita et al. ..... 347/68
7,350,904 B2 * 4/2008 Noguchi et al. ..... 347/72
2002/0097305 A1 * 7/2002 Sumi ..... 347/68

FOREIGN PATENT DOCUMENTS

JP 5-30763 A 2/1993
JP 2005-349714 A 12/2005

* cited by examiner

*Primary Examiner*—K. Feggins
(74) *Attorney, Agent, or Firm*—Birch, Stewart, Kolasch & Birch, LLP

(57) ABSTRACT

A liquid discharge apparatus includes a liquid storage-discharge member having a liquid storage chamber for storing liquid and a liquid outlet for discharging the liquid from the liquid storage chamber to the outside of the liquid storage chamber, a vibration plate formed on the liquid storage-discharge member and a piezoelectric element having a lower electrode, a piezoelectric body and an upper electrode, which are sequentially formed on the vibration plate. The piezoelectric body includes an edge portion including at least a portion of the piezoelectric body, the portion positioned on the outside of the wall position of the liquid storage chamber, and a main portion, which is the remaining portion of the piezoelectric body. Further, the edge portion and the main portion are formed on different base layers from each other and the fracture stress of the edge portion is higher than that of the main portion.

31 Claims, 6 Drawing Sheets

LIQUID DISCHARGE APPARATUS

BACKGROUND OF THE INVENTION

1. Field of the Invention

The present invention relates to a liquid discharge apparatus that includes a liquid storage-discharge member having a liquid storage chamber for storing liquid and a liquid outlet for discharging the liquid from the liquid storage chamber to the outside of the liquid storage chamber, a vibration plate formed on the liquid storage-discharge member and a piezoelectric element having a lower electrode, a piezoelectric body and an upper electrode, the lower electrode, the piezoelectric body and the upper electrode being sequentially formed on the vibration plate.

2. Description of the Related Art

A piezoelectric element including a piezoelectric body and electrodes for applying an electric field to the piezoelectric body is used as an actuator that is mounted in a liquid discharge apparatus, such as an inkjet-type recording head, or the like. The piezoelectric body, which has a piezoelectric characteristic, expands or contracts as the intensity of the electric field applied thereto is increased or reduced. As piezoelectric material, perovskite-type oxide, such as a lead-zirconate-titanate-based oxide (PZT-based oxide), is well known. Such materials are ferroelectric materials, which spontaneously polarize without application of an electric field.

As illustrated in FIG. 7, an inkjet-type recording head according to the related art includes an ink nozzle (liquid storage-discharge member) 220 having an ink chamber (liquid storage chamber) 221 for storing ink, a vibration plate 230 formed on the ink nozzle 220 and a piezoelectric element 210 having a lower electrode 211, a piezoelectric body 213 and an upper electrode 214, for example. The lower electrode 211, the piezoelectric body 213 and the upper electrode 214 are sequentially formed on the vibration plate 230.

As illustrated in FIG. 7, when the ink chamber is pressured by piezoelectric deformation of the piezoelectric element and ink is discharged (jetted) from the ink nozzle, the edge portion (peripheral portion) of the piezoelectric element is constrained (restricted) by the ink nozzle and the central portion of the piezoelectric element slightly warps toward the ink chamber side. In this state, stress tends to be applied to the edge portion of the piezoelectric body (areas in circles in FIG. 7). Therefore, if the inkjet-type recording head is used for long time, there is a risk that the mechanical durability of the piezoelectric body is lost because the piezoelectric body is repeatedly driven in such a manner that displacement of the piezoelectric body occurs. For example, a crack is generated at the interface between a portion of the piezoelectric body, the portion to which high stress is applied, and a portion of the piezoelectric body, the portion to which high stress is not applied. In the specification of the present application, critical stress in general that may affect the durability of the apparatus by generation of a crack or the like is referred to as "fracture stress" in a broad sense (in the specification of the present application, the meaning of the term "fracture stress" is not limited to so-called fracture stress (fracture toughness) in a narrow sense, as a physical property of material).

To prevent such loss of durability, the piezoelectric body may be formed in an area that is smaller than the ink chamber so that no portion of the piezoelectric body is constrained by the ink nozzle. In that case, the piezoelectric element is supported only by the thin vibration plate. Therefore, there is a risk that the durability of the vibration plate is lost in long time. Hence, it is not desirable that the piezoelectric body is formed in such a manner.

An ultrasound actuator including a piezoelectric body having amorphous structure is disclosed in Japanese Unexamined Patent Publication No. 5(1993)-030763. Since grain boundary (crystal grain boundary) is not present in the amorphous structure, the amorphous structure can realize excellent mechanical durability of the ultrasound actuator.

Examples of piezoelectric strains are as follows:

(1) Ordinary piezoelectric strain, which is induced by application of an electric field When the vector component of a spontaneous polarization axis and the direction of application of an electric field are the same, a piezoelectric material expands or contracts in the direction of application of the electric field as the intensity of the electric field applied thereto increases or decreases;

(2) Piezoelectric strain that is induced by non-180-degree reversible rotation of a polarization axis The polarization axis rotates as the intensity of an electric field applied to the piezoelectric material increases or decreases;

(3) Piezoelectric strain utilizing a change in the volume of the piezoelectric material, the change being induced by phase transition of crystals The phase transition occurs by increasing or reducing the intensity of an electric field applied to the piezoelectric material;

(4) Piezoelectric strain utilizing an engineered domain effect

The engineered domain effect is an effect that a larger strain is obtained by using a material having a property that phase transition is induced by application of an electric field and by forming crystal orientation structure including a ferroelectric phase, the direction of the crystal orientation of the crystal orientation structure being different from the direction of the spontaneous polarization axis. (When the engineered domain effect is utilized, the piezoelectric material may be driven in a condition in which phase transition can occur. Alternatively, the piezoelectric material may be driven within a range in which phase transition does not occur; and the like.

These piezoelectric strains (1) through (4) may be used alone or in combination to obtain a desirable piezoelectric strain. Further, in piezoelectric strains (1) through (4), if piezoelectric materials have crystal orientation structure that is appropriate for their respective strain generation principles, it is possible to obtain even larger piezoelectric strains. Therefore, it is desirable that a piezoelectric body has crystal orientation to achieve higher piezoelectric performance.

In Japanese Unexamined Patent Publication No. 2005-349714, polycrystallization of a piezoelectric material has been proposed. An amorphous film is formed using the piezoelectric material. Then, a portion of the amorphous film, the portion positioned on an ink chamber, is selectively annealed by a laser to polycrystallize the portion.

According to the method disclosed in Japanese Unexamined Patent Publication No. 2005-349714, it is possible to form polycrystalline structure in a main portion of the piezoelectric body, the portion positioned on the ink chamber, while maintaining the amorphous structure in the edge portion of the piezoelectric body. The main portion is a portion in which piezoelectric deformation should efficiently occur and the edge portion is a portion to which stress tends to be applied. However, in the method of polycrystallizing the piezoelectric material after temporarily forming amorphous structure, it is difficult to obtain high crystal orientation. Hence, it is difficult to achieve excellent piezoelectric performance.

SUMMARY OF THE INVENTION

In view of the foregoing circumstances, it is an object of the present invention to provide a liquid discharge apparatus including a piezoelectric body that has excellent mechanical durability and excellent piezoelectric performance.

A liquid discharge apparatus according to a first aspect of the present invention is a liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the fracture stress of the edge portion is higher than that of the main portion.

In a liquid discharge apparatus 1, an edge portion of a piezoelectric body and a main portion of the piezoelectric body are formed on different base layers from each other. In contrast, in a liquid discharge apparatus 2, an edge portion of a piezoelectric body and a main portion of the piezoelectric body are formed on the same base layer. The remaining conditions are the same in the liquid discharge apparatus 1 and in the liquid discharge apparatus 2 (the base layer of the edge portion and the main portion in the liquid discharge apparatus 2 is the same as the base layer of the edge portion or the base layer of the main portion in the liquid discharge apparatus 1). When the liquid discharge apparatus 1 and the liquid discharge apparatus 2 are compared with each other, if the results of drive durability tests, which will be described in a later section describing examples, show that the fracture stress of the liquid discharge apparatus 1 is higher than that of the liquid discharge apparatus 2, it can be judged that the fracture stress of the edge portion is higher than that of the main portion.

A liquid discharge apparatus according to a second aspect of the present invention is a liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the Young's modulus of the edge portion is lower than that of the main portion.

As a method for measuring the Young's modulus of each of the edge portion and the main portion, there is a method for measuring the Young's modulus by forcing an indenter into a surface of each of the edge portion and the main portion and by calculating the Young's modulus by using the gradient of a load-depth curve obtained in the process of unloading the indenter. If the Young's modulus of a portion to be evaluated is E, the value of E can be obtained using the following equation:

$$E=(1-V^2)/(1/Er-(1-Vi^2)/Ei)$$

(in the equation,

V: Poisson's ratio of a sample,

Ei: Young's modulus of an indenter,

Vi: Poisson's ratio of the indenter,

1/Er=2·A0.5/S/Π0.5,

S: gradient at the time of starting unloading, and

A: elastic contact projection area).

A liquid discharge apparatus according to a third aspect of the present invention is a liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the average crystal grain diameter of the edge portion is smaller than that of the main portion.

In the liquid discharge apparatus according to the third aspect of the present invention, the edge portion may have amorphous structure. Alternatively, the edge portion may have polycrystalline structure, the average crystal grain diameter of which is smaller that of the main portion. In the amorphous structure, the average crystal grain diameter is regarded as zero.

In the specification of the present application, the "average crystal grain diameter" is obtained by observing a cross section obtained by SEM (scanning electron microscopy), by randomly selecting at least 100 crystal grains and by obtaining the average diameter of the selected crystal grains.

In the liquid discharge apparatuses according to the first through third aspects of the present invention, it is desirable that the edge portion has amorphous structure and the main portion has polycrystalline structure.

Optionally, in the liquid discharge apparatuses according to the first through third aspects of the present invention, the lower electrode may be formed by patterning in an area of the piezoelectric body, the area excluding the edge portion.

In such liquid discharge apparatuses, it is desirable that the base layer of the edge portion of the piezoelectric body has one of amorphous structure and random polycrystalline structure. Alternatively, it is desirable that the base layer of the edge portion of the piezoelectric body includes Si and/or a compound containing Si and that the piezoelectric body includes a compound containing Pb.

There are cases in which a vibration plate and a liquid storage-discharge member are formed by processing a substrate, itself, on which a piezoelectric element is formed. Further, there are cases in which a piezoelectric element is formed on a substrate that is different from the vibration plate and the liquid storage-discharge member. In the former cases, the base layer is the vibration plate. In the latter cases, the base layer is the substrate that is different from both of the vibration plate and the liquid storage-discharge member.

Optionally, in the liquid discharge apparatuses according to the first through third aspects of the present invention, a crystal grain diameter control layer for controlling the average crystal grain diameter of the edge portion of the piezoelectric body so that the average crystal grain diameter of the edge portion becomes smaller than that of the main portion may be formed as the base layer of the edge portion of the piezoelectric body.

In such liquid discharge apparatuses, it is desirable that the crystal grain diameter control layer is one of an amorphous layer and a random polycrystalline layer. Alternatively, it is desirable that the crystal grain diameter control layer includes Si and/or a compound containing Si and the piezoelectric body includes a compound containing Pb. Alternatively, it is desirable that the crystal grain diameter control layer has lower thermal conductivity than the lower electrode.

A liquid discharge apparatus according to a fourth aspect of the present invention is a liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the edge portion has composition that can cause the Young's modulus of the edge portion to become lower than that of the main portion.

The "Young's modulus" of the edge portion and that of the main portion are defined by the Young's moduli of bulk materials of their respective compositions.

In the liquid discharge apparatus of the present invention, the piezoelectric body is structured in such a manner that the fracture stress of the edge portion (a portion including at least a portion on the outside of the wall position of the liquid storage chamber) of the piezoelectric body is higher than that of the main portion of the piezoelectric body. In the piezoelectric body, stress tends to be applied to the edge portion, which is constrained by the liquid storage-discharge member, and piezoelectric deformation should efficiently occur in the main portion. It is possible to form the piezoelectric body in which the fracture stress of the edge portion is higher than that of the main portion, for example, by forming the piezoelectric body in such a manner that an average crystal diameter of the edge portion is smaller than that of the main portion. Alternatively, it is possible to form the piezoelectric body in which the fracture stress of the edge portion is higher than that of the main portion by forming the piezoelectric body in such a manner that the edge portion has composition that can cause the Young's modulus of the edge portion to become lower than that of the main portion.

Further, in the liquid discharge apparatus of the present invention, the edge portion of the piezoelectric body and the main portion thereof are formed on different base layers from each other. Therefore, it is possible to form a piezoelectric body including the edge portion and the main portion that have different properties from each other, even if the edge portion and the main portion are formed in the same process. Further, in the method disclosed in Japanese Unexamined Patent Publication No. 2005-349714, amorphous structure is formed before forming desirable structure. However, in the liquid discharge apparatus of the present invention, the main portion of the piezoelectric body, in which piezoelectric deformation must efficiently occur, can be formed without forming amorphous structure. Further, it is possible to form the main portion of the piezoelectric body in such a manner that the main portion has high crystal orientation.

Therefore, the present invention can provide a liquid discharge apparatus including a piezoelectric body that has excellent mechanical durability and excellent piezoelectric performance.

DESCRIPTION OF THE PREFERRED EMBODIMENTS

First Embodiment of Inkjet-Type Recording Head (Liquid Discharge Apparatus)

Figure 1:
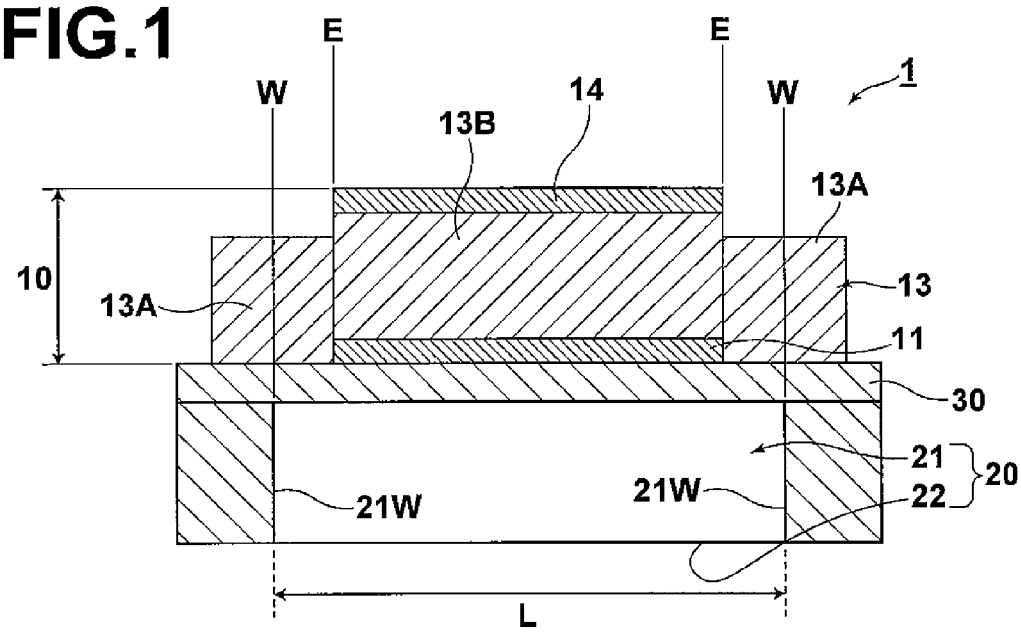
FIG. 1 shows a cross-sectional diagram illustrating an inkjet-type recording head (liquid discharge apparatus) according to a first embodiment of the present invention.

The structure of an inkjet-type recording head according to a first embodiment of the present invention will be described with reference to attached drawings. FIG. 1 is a cross-sectional diagram illustrating a major part of the inkjet-type recording head. In FIG. 1, elements of the inkjet-type recording head are illustrated in appropriate scale, which is different from actual scale, so that they are easily recognized.

An inkjet-type recording head (liquid discharge apparatus) 1 includes an ink nozzle (liquid storage-discharge member) 20. Further, the ink nozzle 20 includes an ink chamber (liquid storage chamber) 21 for storing ink and an ink outlet (liquid outlet) 22 for discharging (jetting) the ink from the ink chamber 21 to the outside of the ink chamber 21. A vibration plate 30 is provided on the ink nozzle 20. Further, a piezoelectric element 10 including a lower electrode 11, a piezoelectric body 13 and an upper electrode 14 is formed on the vibration plate 30. The lower electrode 11, the piezoelectric body 13 and the upper electrode 14 are sequentially formed on the vibration plate 30.

In the inkjet-type recording head 1, an electric field is applied to the piezoelectric body 13 by the lower electrode 11 and the upper electrode 14 in the thickness direction of the piezoelectric body 13. The intensity of the electric field applied to the piezoelectric element 10 is increased or reduced so that the piezoelectric element 10 expands or contracts. Accordingly, ink is discharged from the ink chamber 21 and the discharge amount of the ink is controlled.

In the inkjet-type recording head 1 according to the present embodiment, the ink chamber 21 has open pool structure. In production of the inkjet-type recording head 1, the ink chamber 21 is formed by performing dry-etching or wet-etching on the back side of a substrate. The ink nozzle 20 and the vibration plate 30 are formed by processing the substrate itself. After the ink chamber 21, the ink nozzle 20 and the vibration plate 30 are formed, the piezoelectric element 10 is formed on the front side of the substrate. Alternatively, first, the piezoelectric element 10 may be formed on the front side of the substrate. Then, the ink nozzle 20 and the vibration plate 30 may be formed by processing the substrate.

The ink nozzle 20 and the vibration plate 30 may be formed in one body. Alternatively, the ink nozzle 20 and the vibration plate 30 may be formed in separate bodies. Further, instead of forming the ink nozzle 20 and the vibration plate 30 by processing the substrate itself, the ink nozzle 20 and the vibration plate 30 may be separately attached to the back side of the substrate after the piezoelectric element 10 is formed on the front side of the substrate.

The material of the substrate is not particularly limited. The substrate may be made of silicon, glass, stainless steel (SUS: steel use stainless), yttrium-stabilized zirconia (YSZ), alumina, sapphire, silicon carbide or the like. Further, a layered substrate, such as an SOI substrate, may be used as the substrate. The SOI substrate is formed by sequentially depositing an $SiO_2$ layer and a Si active layer on a silicon substrate.

The main component (base or base substance) of the lower electrode 11 is not particularly limited. The main component of the lower electrode 11 may be metal or metal oxide, such as Au, Pt, Ir, $IrO_2$, $RuO_2$, $LaNiO_3$ and $SrRuO_3$. Alternatively, these kinds of metals and metal oxides may be used in combination. Further, the main component (base or base substance) of the upper electrode 14 is not particularly limited. The main component of the upper electrode 14 may be the aforementioned materials for the lower electrode 11 or an electrode material, such as Al, Ta, Cr and Cu, which is generally used in semiconductor manufacturing process. Alternatively, these kinds of materials maybe used in combination. Further, the thickness of each of the lower electrode 11 and the upper electrode 14 is not particularly limited. Optionally, the thickness may be in the range of 50 to 500 nm.

In the present embodiment, the piezoelectric body 13 is a piezoelectric film (piezoelectric layer) deposited by using a vapor phase growth method, such as a sputtering method. The thickness of the piezoelectric body 13 is not particularly limited. Optionally, the thickness may be in the range of 10 nm to 100 μm. Further optionally, the thickness may be in the range of 100 nm to 20 μm.

The piezoelectric body 13 is made of one kind of perovskite-type oxide or at least two kinds of perovskite-type oxides (the piezoelectric body 13 may include inevitable impurities). Optionally, the piezoelectric body 13 may be made of one kind or at least two kinds of perovskite-type oxides represented by the following general formula (P):

General Formula $ABO_3$ (P)

(In the formula,

A: an A-site element, which is at least one kind of element selected from the group consisting of Pb, Ba, La, Sr, Bi, Li, Na, Ca, Cd, Mg and K, B: a B-site element, which is at least one kind of element selected from the group consisting of Ti, Zr, V, Nb, Ta, Cr, Mo, W, Mn, Sc, Co, Cu, In, Sn, Ga, Zn, Cd, Fe, Ni and lanthanide elements, and O: oxygen element.

In standard, the ratio of the total number of moles of the A-site element to the number of moles of oxygen element is 1:3, and the ratio of the total number of moles of the B-site element to the number of moles of oxygen element is 1:3. However, the ratios may be different from 1:3 as long as perovskite structure can be formed).

As the perovskite-type oxide represented by the general formula (P), there are compounds containing lead, such as lead titanate, lead zirconate-titanate (PZT), lead zirconate, lead lanthanum titanate, lead lanthanum zirconate titanate, lead magnesium niobate zirconium titanate, lead nickel niobate zirconium titanate and lead zinc niobate zirconium titanate, a mixed crystal system of these compounds containing lead, lead-free compounds, such as barium titanate, barium strontium titanate, sodium bismuth titanate, potassium bismuth titanate, sodium niobate, potassium niobate and lithium niobate, and a mixed crystal system of these lead-free compounds.

In the present embodiment, the average crystal grain diameter of an edge portion (peripheral portion) 13A of the piezoelectric body 13 is smaller than that of the remaining portion of the piezoelectric body 13, which is a main portion 13B of the piezoelectric body 13. The edge portion 13A includes at least a portion on the outside of position W of wall 21W of the ink chamber 21. Stress tends to be applied to the edge portion 13A of the piezoelectric body 13 because the edge portion 13A is constrained by the ink nozzle 20. Meanwhile, the main portion 13B is a portion in which piezoelectric deformation must efficiently occur.

The main portion 13B of the piezoelectric body, in which piezoelectric deformation must efficient occur, needs to have perovskite polycrystalline structure. Further, it is desirable that the main portion 13B has high crystal orientation to achieve excellent piezoelectric performance. Meanwhile, the edge portion 13A may have amorphous structure (pyrochlore structure). Alternatively, the edge portion 13A may have polycrystalline structure, the average crystal grain diameter of which is smaller than that of the main portion 13B. The average crystal grain diameter of amorphous structure is regarded as zero.

In the present embodiment, the edge portion 13A and the main portion 13B are formed on different base layers from each other (the base layers are layers or portions of the layers on which the edge portion 13A and the main portion 13B are formed). Therefore, it is possible to form the piezoelectric body 13 including the edge portion 13A and the main portion 13B that have different properties from each other by forming both of the edge portion 13A and the main portion 13B in the same process.

Specifically, in the present embodiment, the lower electrode 11 is formed by patterning in an area of the piezoelectric body 13 excluding the edge portion 13A. In other words, the base layer of the edge portion 13A of the piezoelectric body 13 is the vibration plate 30, and the base layer of the main portion 13B is the lower electrode 11.

The formation conditions (deposition conditions) of the piezoelectric body 13, such as formation temperature (deposition temperature), should be set so that the main portion 13B of the piezoelectric body 13 has perovskite polycrystalline structure having high crystal orientation. It is desirable that the lower electrode 11 has crystal orientation so that the piezoelectric body 13 that has high crystal orientation can be formed on the lower electrode 11.

The average crystal grain diameter of the edge portion 13A can be relatively reduced, for example, by using a substrate (having arbitrary composition) that has amorphous structure or random polycrystalline structure as the substrate of the piezoelectric element 10. In this case, the base layer of the edge portion 13A has amorphous structure or random polycrystalline structure. Therefore, at the beginning of deposition, a layer having low crystallinity is formed in the edge portion 13A by being influenced by the property of the base layer, regardless of the composition of the piezoelectric body 13. In the process of depositing the piezoelectric body 13, the crystalline structure formed at the beginning of deposition is important. If a portion deposited at the beginning of the deposition has low crystallinity, the crystallinity of the whole piezoelectric body 13 becomes low. Therefore, even if the edge portion 13A and the main portion 13B are formed in the same process, it is possible to form the piezoelectric body 13 in such a manner that the average crystal grain diameter of the edge portion 13A is smaller than that of the main portion 13B. Further, it is possible to form amorphous structure in the edge portion 13A. If less crystal grain boundary is present, the mechanical strength is higher. Therefore, if the piezoelectric body 13 is formed as described above, the Young's modulus of the edge portion 13A becomes less than that of the main portion 13B. In other words, it is possible to form the piezoelectric body 13, in which the fracture stress of the edge portion 13A is higher than that of the main portion 13B.

As the substrate having amorphous structure, a substrate made of carbon, glass ($SiO_2$) or the like may be used. As the substrate that has random polycrystalline structure, a ceramic substrate made of $ZrO_2$, $Al_2O_3$, SiC, $Si_3N_4$ or the like may be used.

When a Si single-crystal substrate or an SOI substrate is used as the substrate of the piezoelectric element 10, the base layer of the edge portion 13A of the piezoelectric element 10 is a Si single-crystal layer. If the base layer of the edge portion 13A includes Si, as described above, and if the piezoelectric body 13 includes a compound containing Pb, such as PZT, an amorphous Pb glass layer is formed in the edge portion 13A immediately after starting formation of the piezoelectric body 13. The amorphous Pb glass layer is formed by reaction between Pb ions and Si in the substrate. The thickness of the Pb glass layer is approximately in the range of one to a few μm, depending on the reaction condition.

When the piezoelectric body 13 is deposited, the crystalline structure of a portion formed at the beginning of deposition is important. If the portion formed at the beginning of deposition has low crystallinity, the crystallinity of the whole piezoelectric body 13 becomes low. Therefore, when the apparatus is structured as described above, even if both of the edge portion 13A and the main portion 13B are formed in the same process, it is possible to form the piezoelectric body 13 in which the average crystal grain diameter of the edge portion 13A is smaller than that of the main portion 13B. Further, it is possible to form amorphous structure in the edge portion 13A. If less crystal grain boundary is present in the piezoelectric body 13, the mechanical strength is higher. Further, the Young's modulus of the Pb glass is less than that of general piezoelectric material, and the mechanical strength of the Pb glass is higher than that of general piezoelectric material. Therefore, when the apparatus is structured as described above, it is possible to form a piezoelectric body 13, in which the fracture stress of the edge portion 13A is higher than that of the main portion 13B.

If the base layer of the edge portion 13A includes Si and/or a compound containing Si, and if the piezoelectric body 13 includes a compound containing Pb, the Pb glass layer is formed. The compound containing Si is SiC, $Si_3N_4$, $Sio_2$ or the like. If the base layer of the edge portion 13A and the piezoelectric body 13 that have the aforementioned composition are used in combination, the Pb glass layer is formed in the edge portion 13A. Therefore, even if the same target is used in the edge portion 13A and the main portion, the amount of Pb in the composition of the edge portion 13A becomes slightly different from the amount of Pb in the composition of the main portion 13B.

As described above, the edge portion 13A includes at least a portion of the piezoelectric body, the portion positioned on the outside of wall position W of the ink chamber 21. The inventor of the present invention has found out that the highest stress is applied to the piezoelectric body 13 at wall position W of the ink chamber 21. Therefore, if the mechanical strength of the edge portion 13A, which includes at least a portion of the piezoelectric body, the portion positioned on the outside of wall position W of the ink chamber 21, is increased, it is possible to improve the mechanical durability of the piezoelectric body 13.

It is desirable that the edge portion 13A, the mechanical strength of which should be increased, includes a portion of the piezoelectric body 13, the portion positioned slightly on the inside of wall position W of the ink chamber 21. In that case, it is still necessary that the area of the main portion 13B, in which piezoelectric deformation must efficiently occur, is sufficiently large. Specifically, when the width of the ink chamber 21 is L, it is desirable that inner end position E of the edge portion 13A, the portion in which the mechanical strength should be increased, is set somewhere in the area from wall position W to a position away from the wall position W toward the center of the piezoelectric body 13 by 0.2×L.

The upper electrode 14 should be formed at least on the main portion 13B of the piezoelectric body 13. The upper electrode 14 may also be formed on the edge portion 13A of the piezoelectric body 13.

The inkjet-type recording head 1 according to the present embodiment is structured as described above.

In the present embodiment, the piezoelectric body 13 is structured in such a manner that the average crystal grain diameter of the edge portion 13A (a portion including at least a portion of the piezoelectric body 13, the portion on the outside of wall position W of the ink chamber 21) is smaller that of the main portion 13A, in which piezoelectric deformation must efficiently occur. Stress tends to be applied to the edge portion 13A, which is constrained by the ink nozzle 20. Further, the fracture stress of the edge portion 13A is higher than that of the main portion 13B.

The inkjet-type recording head 1 according to the present invention has excellent mechanical durability even in drive conditions in which a load tends to be applied to the piezoelectric body 13. The load tends to be applied to the piezoelectric body 13 when the maximum displacement at the time of driving is high or when the inkjet-type recording head 1 is driven at high frequency and at high speed or the like.

Further, in the inkjet-type recording head 1, the density of the ink chambers 21 has been increased and an interval (distance) between piezoelectric bodies 13 that are adjacent to each other has become smaller. In the inkjet-type recording head 1 of the present embodiment, in which the mechanical strength of the edge portion 13A of the piezoelectric body 13 has been improved, vibration transmitted between the piezoelectric bodies 13 that are adjacent to each other is reduced. Therefore, it is possible to reduce cross-talk at the time of driving the inkjet-type recording head 1.

Further, in the inkjet-type recording head 1 according to the present embodiment, the edge portion 13A and the main portion 13B are formed on different base layers from each other. Therefore, it is possible to form the piezoelectric body 13 including the edge portion 13A and the main portion 13B that have different properties from each other in the same process. In the method disclosed in Japanese Unexamined Patent Publication No. 2005-349714, amorphous structure needs to be formed before formation of desirable structure. However, in the inkjet-type recording head 1 according to the present embodiment, the main portion 13B of the piezoelectric body 13, in which piezoelectric deformation must efficiently occur, can be formed without forming amorphous structure. Further, it is possible to form the main portion 13B that has high crystal orientation.

Therefore, in the present embodiment, it is possible to provide the inkjet-type recording head 1 including the piezoelectric body 13 that has excellent mechanical durability and excellent piezoelectric performance.

Second Embodiment of Inkjet-Type Recording Head (Liquid Discharge Apparatus)

Figure 2:
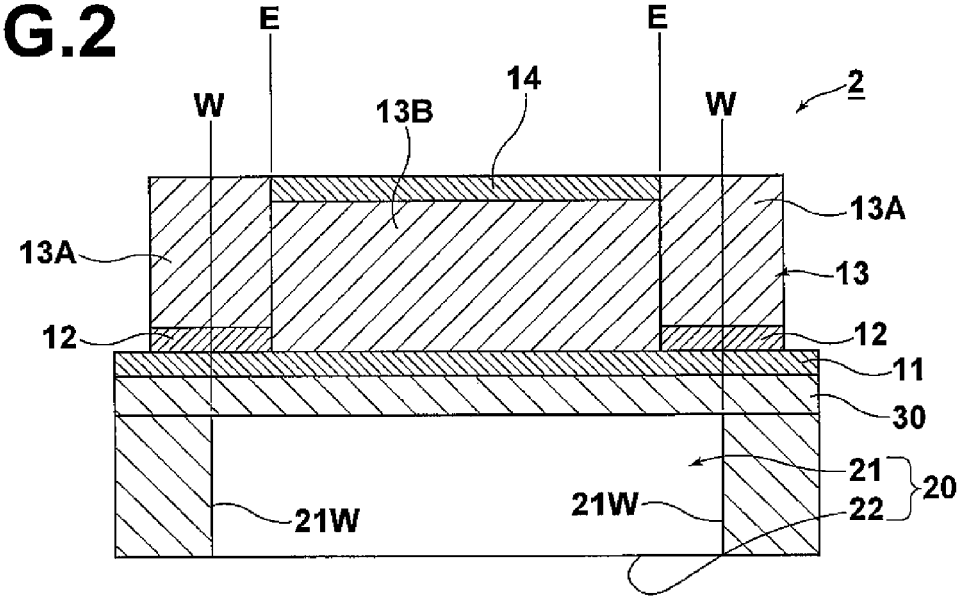
FIG. 2 shows a cross-sectional diagram illustrating an inkjet-type recording head (liquid discharge apparatus) according to a second embodiment of the present invention.

With reference to the attached drawings, the structure of an inkjet-type recording head according to the second embodiment of the present invention will be described. FIG. 2 is a cross-sectional diagram corresponding to FIG. 1, which illustrates the inkjet-type recording head according to the first embodiment of the present invention. In FIG. 2, the same reference numerals as those of the first embodiment will be used for the corresponding elements and explanation thereof will be omitted.

The basic structure of an inkjet-type recording head (liquid discharge apparatus) 2 according to the present embodiment is similar to that of the inkjet-type recording head according to the first embodiment. However, in the inkjet-type recording head 2 according to the present embodiment, the lower electrode 11 is evenly formed in the entire area of the substrate. Further, a crystal grain diameter control layer 12, as the base layer of the edge portion 13A of the piezoelectric body 13, is formed on the lower electrode 11. The crystal grain diameter control layer 12 controls the average crystal grain diameter of the edge portion 13A so that the average crystal grain diameter of the edge portion 13A becomes smaller than that of the main portion 13B. The lower electrode 11 may be formed by patterning only in a portion of the piezoelectric body 13, the portion excluding the edge portion 13A, in a manner similar to the first embodiment.

As the crystal grain diameter control layer 12, an amorphous layer or a random polycrystalline layer may be used. The crystal grain diameter control layer 12 that has amorphous structure is a layer made of carbon, an amorphous oxide such as glass ($SiO_2$) and ITO (indium tin oxide), amorphous metal or the like. The crystal grain diameter control layer 12 that has random polycrystalline structure is a ceramic layer made of $ZrO_2$, $Al_2O_3$, SiC, $Si_3N_4$ or the like.

A piezoelectric body that has low crystallinity is formed on the crystal grain diameter control layer 12 that has amorphous structure or random polycrystalline structure. The reason why the piezoelectric body that has the low crystallinity is formed is similar to the reason why the piezoelectric body that has low crystallinity is formed on the base layer having amorphous structure or random polycrystalline structure in the first embodiment. In the first embodiment, the substrate having amorphous structure or random polycrystalline structure is used as the substrate of the piezoelectric element.

If the piezoelectric body 13 includes a compound containing Pb, a layer containing Si and/or a compound containing Si may be used as the crystal grain diameter control layer 12. The compound containing Si is SiC, $Si_3N_4$, $SiO_2$ or the like. In this case, it is not necessary that the crystal grain diameter control layer 12 has crystal orientation. When the apparatus is structured as described above, a piezoelectric body that has low crystallinity is formed on the crystal grain diameter control layer 12. The reason why the piezoelectric body that has low crystallinity is formed is similar to the reason why a piezoelectric body that has low crystallinity is formed on a substrate, such as a Si single-crystal substrate or an SOI substrate, when the piezoelectric body includes a compound containing Pb in the first embodiment.

As the crystal grain diameter control layer 12, a layer that has lower thermal conductivity than the lower electrode 11 may be used. The layer that has lower thermal conductivity than the lower electrode 11 is a layer made of glass ($SiO_2$), porous ceramic or the like. The layer made of porous ceramic is a porous ceramic layer made of $ZrO_2$, $Al_2O_3$, SiC, $Si_3N_4$ or the like. The thermal conductivity of the glass layer and the porous ceramic layer is lower than that of metal or metal oxide that is used in the lower electrode 11. The thermal conductivity of the glass layer and that of the porous ceramic layer are smaller than that of the metal or metal oxide at least by a digit. Since the porous ceramic layer has a multiplicity of pores formed therein, the porous ceramic layer has a high thermal insulation characteristic. In other words, the porous ceramic layer has low thermal conductivity.

The piezoelectric body 13 is deposited by setting the deposition temperature so that high-quality crystals grow in the main portion 13B of the piezoelectric body 13. However, since the crystal grain diameter control layer 12 has lower thermal conductivity than the lower electrode 11, the crystal grain diameter control layer 12 needs longer time to reach the set temperature. Therefore, it is possible to start deposition of the piezoelectric body 13 in a state in which the temperature of the lower electrode 11 has reached a temperature at which high-quality crystals can grow but the temperature of the crystal grain diameter control layer 12 has not reached the temperature at which high-quality crystals can grow. When deposition is performed, it is desirable that the substrate is rapidly heated because a difference between the temperature of the lower electrode 11 and that of the crystal grain diameter control layer 12 at the time of starting deposition can be increased.

In the PZT-based piezoelectric body 13, high-quality perovskite crystals grow normally at a temperature within the range of 400 to 600° C., depending on conditions, such as plasma. If the temperature is lower than 400° C., pyrochlore phase is generated, and amorphous structure is formed. For example, when deposition of the piezoelectric body 13 is started, if the surface temperature of the lower electrode 11 is in the range of 500 to 570° C. and the surface temperature of the crystal grain diameter control layer 12 is 350° C. or less, a layer that has low crystallinity is formed in the edge portion at the beginning of deposition of the piezoelectric body 13. When the piezoelectric body 13 is deposited, the crystalline structure of the piezoelectric body 13 that is formed at the beginning of deposition is important. If the crystallinity of the piezoelectric body 13 that is formed at the beginning of deposition is low, the crystallinity of the whole piezoelectric body 13 becomes low. Therefore, even if the edge portion 13A and the main portion 13B are formed in the same process, it is possible to form the edge portion 13A and the main portion 13B in such a manner that the average crystal grain diameter of the edge portion 13A becomes smaller that of the main portion 13B. Further, it is possible form the edge portion 13A that has amorphous structure. If less crystal grain boundaries are present, the mechanical strength of the piezoelectric body 13 is higher. Therefore, in the apparatus structured as described above, it is possible to form the piezoelectric body 13 in which the fracture stress of the edge portion 13A is higher than that of the main portion 13B.

The inkjet-type recording head 2 according to the present embodiment is structured as described above.

In the present embodiment, the average crystal grain diameter of the edge portion 13A of the piezoelectric body 13 is smaller than that of the main portion 13B of the piezoelectric body 13. The edge portion 13A is constrained by the ink nozzle 20 and stress tends to be applied to the edge portion 13A. In the main portion 13B, piezoelectric deformation must efficiently occur. Further, in the present embodiment, the fracture stress of the edge portion 13A is higher than that of the main portion 13B.

Further, in the inkjet-type recording head 2 of the present embodiment, the crystal grain diameter control layer 12 is formed as the base layer of the edge portion 13A. Therefore, the edge portion 13A and the main portion 13B are formed on different base layers from each other. Hence, it is possible to form the piezoelectric body 13 including the edge portion 13A and the main portion 13B that have different properties from each other through the same process. In the method disclosed in Japanese Unexamined Patent Publication No. 2005-349714, amorphous structure is formed before forming desirable structure. However, in the inkjet-type recording head 2 according to the present embodiment, the main portion 13B of the piezoelectric body 13, in which piezoelectric deformation must efficiently occur, can be formed without forming amorphous structure. Further, it is possible to form the main portion 13B that has high crystal orientation.

Therefore, in the present embodiment, it is possible to provide the inkjet-type recording head 2 including the piezoelectric body 13 that has excellent mechanical durability and excellent piezoelectric performance.

Design Modification

In the first and second embodiments, it is desirable that crystal grains in the edge portion 13A are distributed in such a manner that the average crystal grain diameter becomes larger toward the inner side (the main portion 13B side) of the edge portion 13A. In other words, the average crystal grain diameter becomes smaller toward the outer side of the edge portion 13A. Further, it is desirable that the average crystal grain diameter in the edge portion 13A and the average crystal grain diameter in the main portion 13B do not sharply differ from each other. It is desirable that the average crystal grain diameter gradually changes between the edge portion 13A and the main portion 13B because stress applied to the boundary (interface) between the edge portion 13A and the main portion 13B can be eased.

Figure 3:
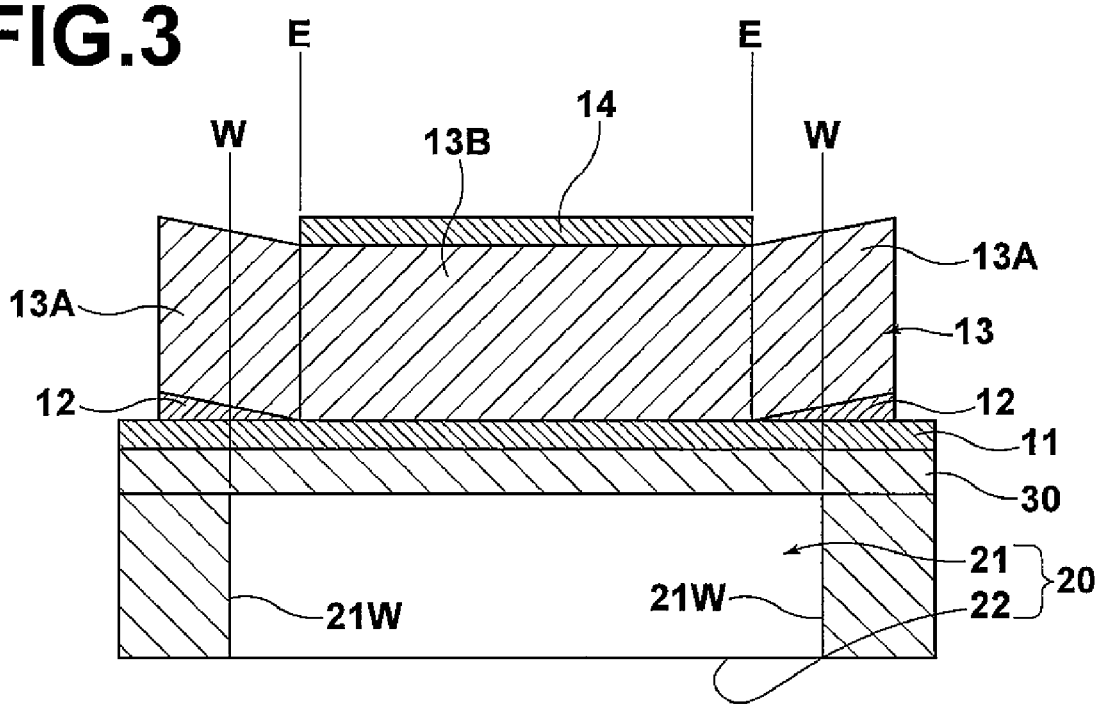
FIG. 3 shows a diagram illustrating an example of design modification to the inkjet-type recording head illustrated in FIG. 2.

For example, in an embodiment in which the crystal grain diameter control layer 12 that has low thermal conductivity is provided, the crystal grain diameter control layer 12 may have thickness distribution in which the thickness becomes relatively thinner toward the main portion 13A side and relatively thicker toward the outer side, as illustrated in FIG. 3. By forming the crystal grain diameter control layer 12 in such a manner, temperature distribution may be formed in the crystal grain diameter control layer 12 at the time of starting deposition of the piezoelectric body 13. Accordingly, it is possible to form the edge portion 13A in such a manner that the average crystal grain diameters are distributed as described above. In the example illustrated in FIG. 3, the thickness of the crystal grain diameter control layer 12 is continuously changed. Alternatively, the thickness of the crystal grain diameter control layer 12 may be changed stepwise. It is possible to form the crystal grain diameter control layer 12 that has thickness distribution by using a method, such as a multi-step lithography or etching.

Further, in the piezoelectric body 13, the edge portion 13A may have composition that can cause the Young's modulus of the edge portion 13A to become lower than that of the main portion 13B. The Young's modulus is one of indices for judging the mechanical strength. For example, in a Pb-containing piezoelectric material, such as PZT-based material, there is a tendency that if the Pb mole content increases, the average crystal grain diameter of the Pb-containing piezoelectric material increases and the Young's modulus increases. It is desirable that the Young's modulus of the edge portion 13A is less than or equal to 80% of that of the main portion 13B. Optionally, the Young's modulus of the edge portion 13A may less than or equal to 50% of that of the main portion 13B.

As a method for forming the piezoelectric body 13 including the edge portion 13A and the main portion 13B which have different composition from each other, a composition control layer for controlling the composition of the edge portion 13A may be formed as the base layer of the edge portion 13A. The composition control layer is formed instead of the crystal grain diameter control layer 12 of the second embodiment. In this case, the lower electrode 11 may be formed in the entire area of the substrate in a manner similar to the second embodiment. Alternatively, the lower electrode 11 may be formed by patterning only in a portion of the piezoelectric body 13, the portion excluding the edge portion 13A, in a manner similar to the first embodiment.

The composition control layer includes metal, such as La, Nd, Nb, Sb, Bi, Ta and W, or its oxide. If the piezoelectric body is formed on the composition control layer as described above, the aforementioned element of the composition control layer diffuses to the piezoelectric body and is added as donor ions (the piezoelectric body is doped with the donor ions). The Young's modulus of the edge portion 13A of the piezoelectric body 13, the edge portion to which the donor ions have been added, is relatively lower than that of the main portion 13B of the piezoelectric body 13, the main portion to which the donor ions have not been added. Further, the thickness of the composition control layer is approximately in the range of a few nm to a few hundreds μm and the composition control layer is designed based on a donor dope amount, the amount of donors to be added to the edge portion 13A.

If the aforementioned method is adopted, it is possible to form the piezoelectric body 13 including the edge portion 13A and the main portion 13B that have different composition from each other through the same process. In the apparatus as described above, it is possible to make the fracture stress of the edge portion 13A of the piezoelectric body 13 become higher than that of the main portion 13B of the piezoelectric body 13. The edge portion 13A is constrained by the ink nozzle 20 and stress tends to be applied to the edge portion 13A. The main portion 13B is a portion in which piezoelectric deformation must efficiently occur. In the aforementioned method, it is possible to achieve an advantageous effect similar to those achieved in the first and second embodiments.

In the case in which the composition control layer is formed so that the composition of the edge portion 13A of the piezoelectric body 13 becomes different from that of the main portion 13B of the piezoelectric body 13, the thickness of the composition control layer may be distributed in a manner similar to the crystal grain diameter control layer 12 illustrated in FIG. 3. The composition control layer may be formed in such manner that the thickness of the main-portion-13B-side portion of the composition control layer is relatively thin and that of the outer-side portion of the composition control layer is relatively thick (the thickness of the composition control layer may change continuously or stepwise). Accordingly, it is possible to form the edge portion 13A in such a manner that the composition and the Young's modulus gradually change in the edge portion 13A. In this case, it is possible to suppress diffusion of donor ions to the main portion 13B in the horizontal direction. Further, it is possible to ease the stress applied to the boundary between the edge portion 13A and the main portion 13B. Therefore, an advantageous effect can be achieved by forming the distribution of the thickness as described above.

Inkjet-Type Recording Apparatus

Figure 4:
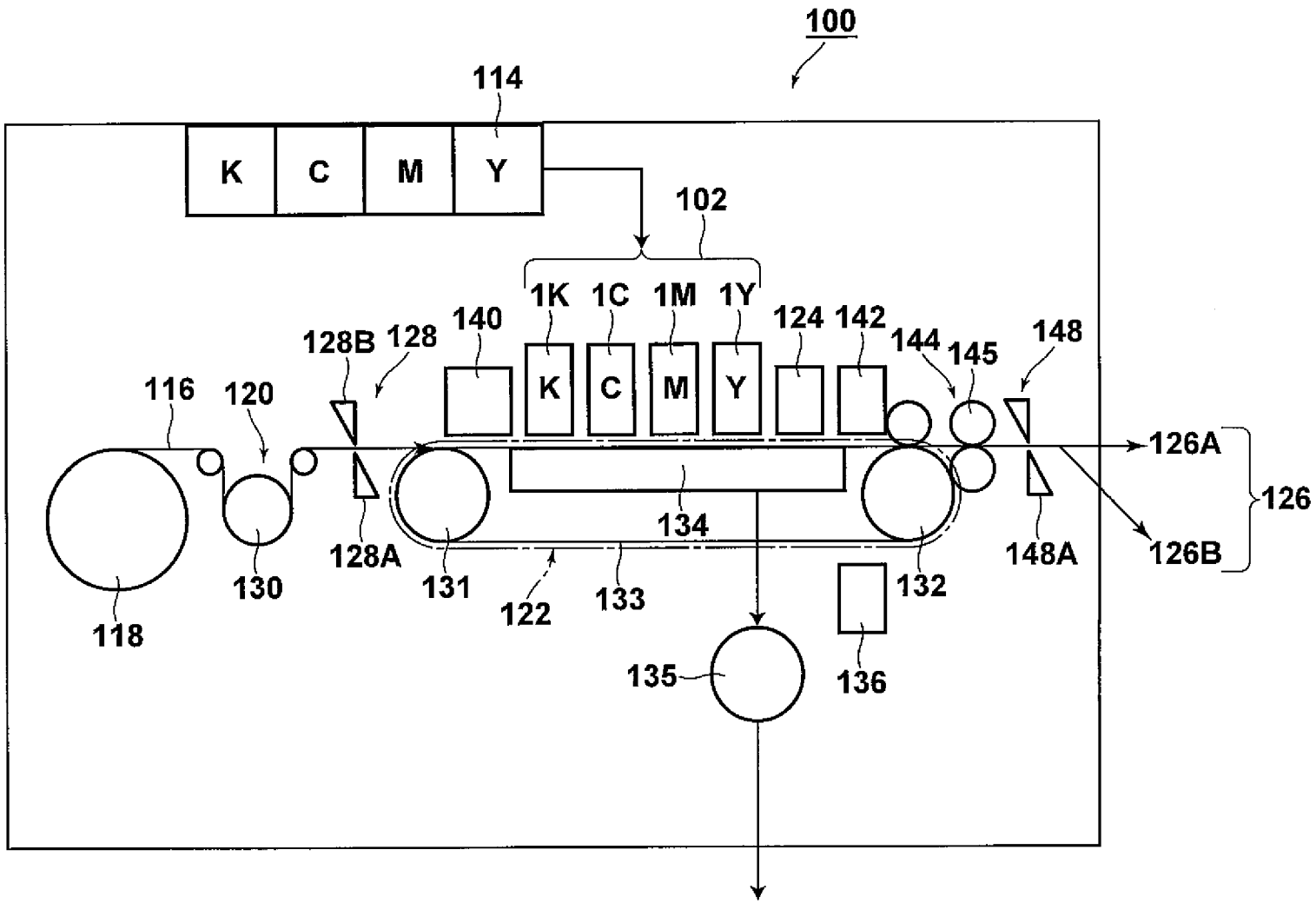
FIG. 4 shows a diagram illustrating an example of the structure of an inkjet-type recording apparatus including the inkjet-type recording head illustrated in FIG. 1.
Figure 5:
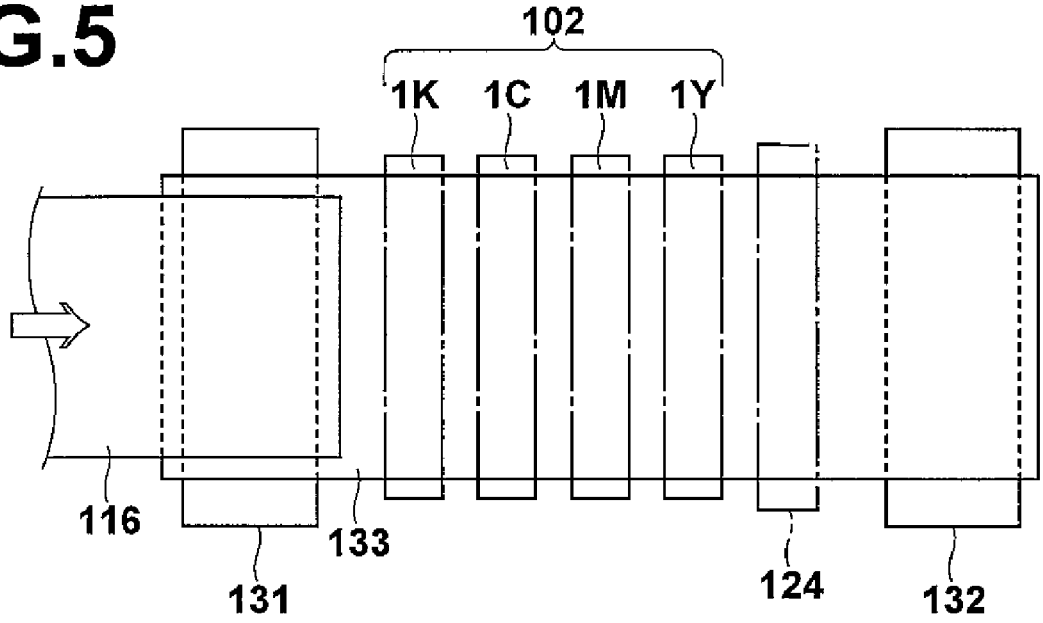
FIG. 5 shows a diagram illustrating a partial upper-surface view of the inkjet-type recording apparatus illustrated in FIG. 4.

An example of the structure of an inkjet-type recording apparatus including an inkjet-type recording head 1 according to the aforementioned embodiment will be described with reference to FIGS. 4 and 5. FIG. 4 is a diagram illustrating the whole inkjet-type recording apparatus. FIG. 5 is a partial plan view of the inkjet-type recording apparatus.

An inkjet-type recording apparatus 100, illustrated in FIGS. 4 and 5, includes a print unit 102, an ink storage/load unit 114, a paper feed unit 118, a decurl-processing unit 120, a suction belt conveyance unit 122, a print detection unit 124 and a paper discharge unit 126. The print unit 102 includes a plurality of inkjet-type recording heads (hereinafter, simply referred to as "heads") 1K, 1C, 1M and 1Y for respective ink colors. The ink storage/load unit 114 stores ink to be supplied to each of the heads 1K, 1C, 1M and 1Y, and the paper feed unit 118 supplies recording paper 116. The decurl-processing unit 120 eliminates the curl of the recording paper 116. The suction belt conveyance unit 122 is placed so as to face a nozzle surface (ink discharge surface) of the print unit 102. The suction belt conveyance unit 122 conveys the recording paper 116 while keeping the recording paper 116 flat. The print detection unit 124 reads a result of printing performed by the print unit 102. The paper discharge unit 126 discharges printed recording paper (printed paper or print) to the outside of the inkjet-type recording apparatus 100.

Each of the heads 1K, 1C, 1M and 1Y, which form the print unit 102, is the inkjet-type recording head 1 according to each of the aforementioned embodiments.

The decurl-processing unit 120 performs decurl-processing by heating the recording paper 116 using a heating drum 130. The recording paper 116 is heated in a direction opposite to the direction of the curl.

In an apparatus using roll paper, a cutter 128 for cutting paper is provided on the downstream side of the decurl-processing unit 120, as illustrated in FIG. 4. The roll paper is cut into a piece of paper having a desirable size by the cutter 128. The cutter 128 includes a fixed blade 128A and a round blade 128B. The fixed blade 128A has a length that is longer than or equal to the width of the conveyance path of the recording paper 116. The round blade 128B moves along the fixed blade 128A. The fixed blade 128A and the round blade 128B are placed on either side of the conveyance path. The fixed blade 128A is provided on the back side of a printing surface and the round blade 128B is provided on the front side of the printing surface. If cut paper is used in an apparatus, the cutter 128 is not required.

After decurl-processing is performed on the recording paper 116 and the recording paper 116 is cut into a piece of paper, the piece of paper is delivered to the suction belt conveyance unit 122. The suction belt conveyance unit 122 includes rollers 131 and 132 and an endless belt 133 that is wound around the rollers 131 and 132. Further, the suction belt conveyance unit 122 is formed in such a manner that at least a portion of the suction belt conveyance unit 122, the portion facing the nozzle surface of the print unit 102 and the sensor surface of the print detection unit 124, has a horizontal surface (flat surface).

The width of the belt 133 is wider than that of the recording paper 116. Further, a multiplicity of suction holes (not illustrated) are formed in the surface of the belt. Further, a suction chamber 134 is provided in the inside of the belt 133, which is wound around the rollers 131 and 132. The suction chamber 134 is provided at a position facing the nozzle surface of the print unit 102 and the sensor surface of the print detection unit 124. The suction chamber 134 is sucked using a fan 135 and negatively pressured. Accordingly, the recording paper 116 on the belt 133 is held by suction.

Power from a motor (not illustrated) is transmitted to at least one of the rollers 131 and 132, around which the belt 133 is wound, and the belt 133 is driven in the clockwise direction in FIG. 4. Then, the recording paper 116 held on the belt 133 is conveyed from the left to the right in FIG. 4.

When frameless print or the like is performed, ink attaches to the belt 133. Therefore, a belt cleaning unit 136 is provided at a predetermined position (an appropriate position that is not in a printing area) on the outside of the belt 133.

In the paper conveyance path formed by the suction belt conveyance unit 122, a heating fan 140 is provided on the upstream side of the printing unit 102. The heating fan 140 sends heated air onto the recording paper 116 before printing and heats the recording paper 116. If the recording paper 116 is heated immediately before printing, ink dries quickly after the ink reaches the surface of the recording paper 116.

The print unit 102 is a so-called full-line-type head (please refer to FIG. 5). In the full-line-type head, a line-type head that has a length corresponding to the maximum width of paper is arranged in a direction (main scan direction) orthogonal to the conveyance direction of paper. Each of the print heads 1K, 1C, 1M and 1Y is formed by a line-type head, in which a plurality of ink outlets (nozzles) are arranged at least in a length exceeding the length of a side of recording paper 116 in maximum size for the inkjet-type recording apparatus 100.

The heads 1K, 1C, 1M and 1Y, which correspond to black (K), cyan (C), magenta (M) and yellow (Y), are sequentially arranged from the upstream side along the conveyance direction of the recording paper 116. While the recording paper 116 is conveyed, color ink is discharged (jetted) from each of the heads 1K, 1C, 1M and 1Y. Accordingly, a color image is recorded on the recording paper 116.

The print detection unit 124 includes a line sensor for imaging the result of deposition of ink droplets by the print unit 102 and the like. The print detection unit 124 detects failure in discharge, such as choking of a nozzle hole, based on the image of the deposited ink droplets that has been read by the line sensor.

Further, a post-dry unit 142 is provided on the downstream side of the print detection unit 124. The post-dry unit 142 includes a heating fan for drying the printed image surface of the recording paper 116. It is desirable that after printing, the print surface of the recording paper 116 is not touched before the ink dries. Therefore, it is desirable that hot wind (air) is sent out to the print surface.

Further, a heating/pressuring unit 144 is provided on the downstream side of the post-dry unit 142. The heating/pressuring unit 144 is provided to control the degree of gloss of the image surface. In the heating/pressuring unit 144, pressure is applied to the image surface using a pressuring roller 145 that has predetermined uneven surface form while the image surface is heated. Accordingly, uneven form is transferred onto the image surface.

A print is obtained, as described above, and the print is discharged (output) from the paper discharge unit 126. It is desirable that the paper discharge unit 126 discharges a print of an image that should be primarily printed (a print of a target image) and a test print separately. In this inkjet-type recording apparatus 100, a classification means (not illustrated) for switching the paper discharge path is provided. The classification means classifies prints into prints of images that should be primarily printed and test prints and sends them to discharge units 126A and 126B, respectively.

When a print of an image that should be primarily printed and a test print are printed on the same paper that has a relatively large size, a cutter 148 should be provided and the portion of the test print should be removed from the paper.

The inkjet-type recording apparatus 100 is structured as described above.

EXAMPLES

Examples of the present invention will be described.

Example 1

An ink chamber was formed by performing reactive ion etching on the back side of a Si single-crystal substrate. Then, a vibration plate and an ink nozzle having open pool structure were formed by processing the substrate itself. The ink nozzle includes an ink chamber and an ink outlet. The thickness of the vibration plate is approximately 10 μm. Further, the thickness of the ink chamber is approximately 500 μm and the width of the ink chamber is 300 μm.

Next, a lower electrode was formed by patterning by using a lift off method. Specifically, a photoresist was formed on a surface of the substrate by patterning by using a photolithography method. The photoresist was formed by patterning only in an area corresponding to an edge portion of a piezoelectric member, which would be formed later. Then, the lower electrode was evenly deposited on the entire area of the substrate by using a sputtering method. The lower electrode has layered structure in which a Ti layer that has a thickness of 200 nm and an Ir layer that has a thickness of 500 nm are deposited one on the other. Then, the photoresist was removed by soaking the photoresist in acetone. Accordingly, patterning was performed in such a manner that only the lower electrode excluding the area corresponding to the edge portion of the piezoelectric body, which would be formed later, remained without being removed. The lower electrode remained only in an inner area of the substrate, the area 20 μm away from the wall position of the ink chamber.

Next, a PZT ($PbZro_{0.52}Ti_{0.48}O_3$) piezoelectric body that has a thickness of 5.0 μm was formed at a substrate temperature of 550° C. by using a sputtering method. Finally, a Pt upper electrode that has a thickness of 100 nm was formed on the piezoelectric body by using a sputtering method. Accordingly, an inkjet-type recording head according to the present invention was obtained.

XRD Evaluation

After the piezoelectric body was deposited, X-ray diffraction (XRD) measurement was performed. The edge portion of the piezoelectric body, the base layer of the edge portion being the substrate, had amorphous structure. However, the main portion of the piezoelectric body, the base layer of the main portion being the lower electrode, had polycrystalline structure having (100) crystal orientation (the degree of orientation was 90%).

The inventor of the present invention performed a separate experiment. In the experiment, a lower electrode was evenly formed on the entire area of a surface of the substrate, and a PZT piezoelectric body having amorphous structure was deposited at room temperature by using a sputtering method. After the PZT piezoelectric body was formed, the PZT piezoelectric body was polycrystallized by being annealed at 600° C. Then, (100) crystal orientation degree was less than or equal to 70%. This result shows that in this example, it is possible to make the main portion of the piezoelectric body, the portion in which piezoelectric deformation must efficiently occur, have polycrystalline structure having a higher degree of orientation than the degree of orientation obtained in the method disclosed in Japanese Unexamined Patent Publication No. 2005-349714. In the method disclosed in Japanese Unexamined Patent Publication No. 2005-349714, crystallization is performed after forming amorphous structure.

SEM Observation

Figure 6A:
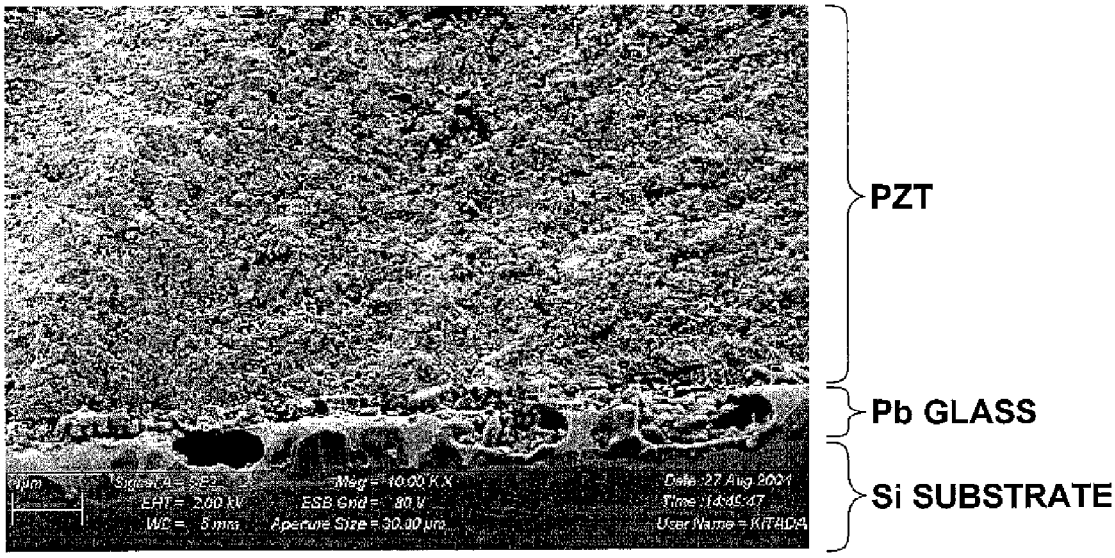
FIG. 6A is a photograph of a cross section of an edge portion of a piezoelectric body in Example 1, obtained by SEM (the base layer of the edge portion of the piezoelectric body is a substrate)
Figure 6B:
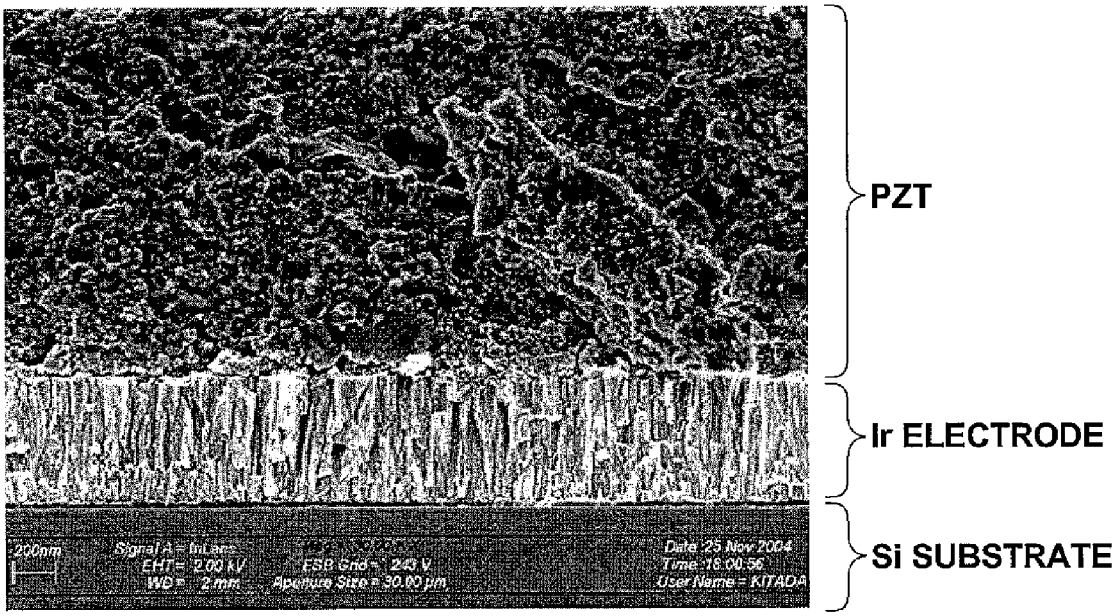
FIG. 6B is a photograph of a cross section of a main portion of a piezoelectric body in Example, 1, obtained by SEM (the base layer of the main portion of the piezoelectric body is a lower electrode)
Figure 7:
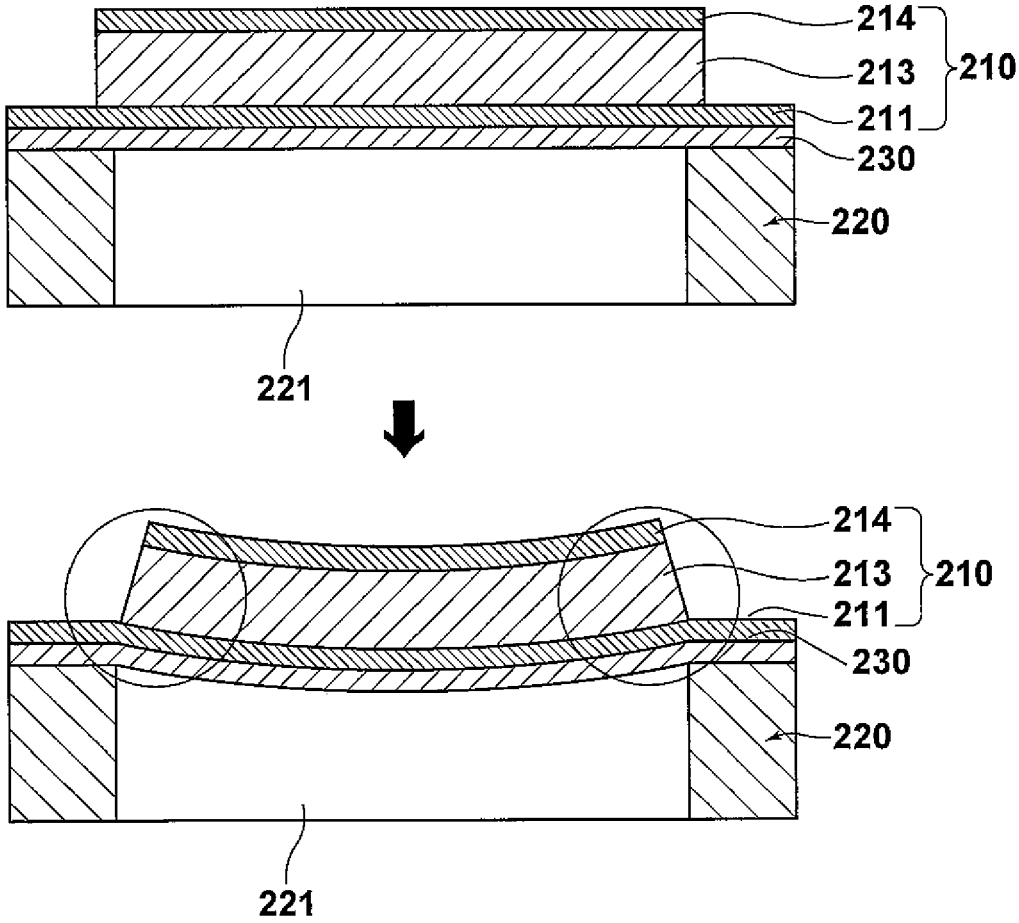
FIG.7 RELATED ART
FIG. 7 is a diagram for explaining the structure of an inkjet-type recording head according to the related art and the problem thereof.

The cross section of the piezoelectric body was observed by SEM. FIG. 6A shows a photograph of a cross section of the edge portion of the piezoelectric body obtained by SEM. The base layer of the edge portion is a substrate. FIG. 6B shows a photograph of a cross section of the main portion of the piezoelectric body obtained by SEM. The base layer of the main portion is the lower substrate.

As illustrated in FIG. 6A, in the edge portion of the piezoelectric body, the base layer of which was a Si substrate, a Pb glass layer was formed on the substrate. Further, a PZT film having amorphous structure was formed on the Pb glass layer. In contrast, as illustrated in FIG. 6B, in the main portion of the piezoelectric body, the base layer of which was the lower electrode, a PZT film having polycrystalline structure was formed.

Drive Durability Test

While voltage was applied to the piezoelectric body at 30V, frequency applied to the piezoelectric body was changed to change the displacement amount of the piezoelectric body.

The displacement amount of the piezoelectric body increases as the frequency becomes closer to a resonance frequency. Further, stress applied to the film increases.

When the lower electrode was evenly formed on the entire area of a surface of a substrate and the edge portion of the piezoelectric body did not have amorphous structure, in other words, when the whole piezoelectric body was formed as a crystal orientation film, a crack was generated in the piezoelectric body at a stress of 300 MPa. However, in Example 1, in which the edge portion had amorphous structure, a crack was generated in the piezoelectric body at a stress of 500 MPa. This result shows that the durability was improved.

Example 2

In a manner similar to Example 1, a Si single-crystal substrate was used and a vibration plate and an ink nozzle having open pool structure were formed by processing the substrate itself. The ink nozzle has an ink chamber and an ink outlet. Next, a lower electrode was evenly formed on the entire area of a surface of the substrate by using a sputtering method. The lower electrode has layered structure in which a Ti layer having a thickness of 200 nm and an Ir layer having a thickness of 500 nm are deposited one on the other.

Next, an $SiO_2$ amorphous film, as a crystal grain diameter control layer, that has a thickness of 1.0 μm was formed by using a sputtering method and a photolithography method. The $SiO_2$ amorphous film was formed by patterning only in an area corresponding to the edge portion of the piezoelectric body, which would be formed later. The inner end of the crystal grain diameter control layer was positioned 20 μm away from the wall position of the ink chamber toward the center of the substrate.

Next, the same target as Example 1 was used, and a piezoelectric body that has a thickness of 5.0 μm was formed at a substrate temperature of 550° C. by using a sputtering method. Finally, a Pt upper electrode that has a thickness of 100 nm was formed on the piezoelectric body by using a sputtering method. Accordingly, an inkjet-type recording head according to the present invention was obtained.

XRD Evaluation

In a manner similar to Example 1, XRD measurement was performed after the piezoelectric body was deposited. The edge portion of the piezoelectric body, the base layer of which was an $SiO_2$ amorphous layer, had amorphous structure. In contrast, the main portion of the piezoelectric body, the base layer of which was the lower electrode, had polycrystalline structure of (100) crystal orientation (the degree of orientation was 90%). This result shows that in Example 2, in a manner similar to Example 1, it is possible to make the main portion of the piezoelectric body, the portion in which piezoelectric deformation must efficiently occur, have polycrystalline structure having a higher degree of orientation than the degree of orientation obtained in the method disclosed in Japanese Unexamined Patent Publication No. 2005-349714. In the method disclosed in Japanese Unexamined Patent Publication No. 2005-349714, crystallization is performed after forming amorphous structure.

SEM Observation

The cross section of the piezoelectric body was observed by SEM. The edge portion of the piezoelectric body, the base layer of which was an $SiO_2$ amorphous film, had amorphous structure. However, the main portion of the piezoelectric body, the base layer of which was the lower electrode, had polycrystalline structure.

Drive Durability Test

In a manner similar to Example 1, a drive durability test was conducted. When a crystal grain diameter control layer was not formed and the entire area of the piezoelectric body was formed as a crystal orientation film without forming the edge portion of the piezoelectric body in amorphous structure, a crack was generated in the piezoelectric body at a stress of 300 Mpa. However, when a crystal grain diameter control layer was formed and the edge portion having amorphous structure was formed, a crack was generated at a stress of 500 Mpa. This result shows that the durability was improved in this example.

Example 3

In a manner similar to Example 1, a Si single-crystal substrate was used and a vibration plate and an ink nozzle having open pool structure were formed by processing the substrate itself. The ink nozzle has an ink chamber and an ink outlet. Then, a lower electrode was evenly formed on the entire area of a surface of the substrate by using a sputtering method. The lower electrode has layered structure in which a Ti layer having a thickness of 200 nm and an Ir layer having a thickness of 500 nm are deposited one on the other.

Then, in a manner similar to Example 1, patterning was performed by using a lift off method in such a manner that only the lower electrode excluding an area corresponding to the edge portion of the piezoelectric body, which would be formed later, remained without being removed. The lower electrode remained only in an inner area that is 20 μm away from the wall position of the ink chamber.

Next, an $La_2O_3$ film, as a composition control layer, that has a thickness of 500 nm was formed by using a sputtering method and a photolithography method. The $La_2O_3$ film was formed only in the edge portion of the piezoelectric body, which would be formed later. The inner end of the composition control layer was 20 μm away from the wall position of the ink chamber toward the center of the substrate.

Next, the same target as Example 1 was used, and a piezoelectric body that has a thickness of 5.0 μm was formed at a substrate temperature of 550° C. by using a sputtering method. Finally, a Pt upper electrode that has a thickness of 100 nm was formed on the piezoelectric body by using a sputtering method. Accordingly, an inkjet-type recording head according to the present invention was obtained.

Drive Durability Test

In a manner similar to Example 1, a drive durability test was conducted. When a composition control layer was not formed, a crack was generated in the piezoelectric body at a stress of 300 Mpa. However, in Example 3, in which the composition control layer was formed, a crack was generated at a stress of 450 Mpa. This result shows that the durability was improved.

The liquid discharge apparatus of the present invention may be used as an inkjet-type recording head or the like.

What is claimed is:

1. A liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the fracture stress of the edge portion is higher than that of the main portion.

2. A liquid discharge apparatus, as defined in claim 1, wherein the edge portion has amorphous structure, and wherein the main portion has polycrystalline structure.

3. A liquid discharge apparatus, as defined in claim 1, wherein the lower electrode is formed by patterning in an area of the piezoelectric body, the area excluding the edge portion.

4. A liquid discharge apparatus, as defined in claim 3, wherein the base layer of the edge portion of the piezoelectric body has one of amorphous structure and random polycrystalline structure.

5. A liquid discharge apparatus, as defined in claim 3, wherein the base layer of the edge portion of the piezoelectric body includes Si and/or a compound containing Si, and wherein the piezoelectric body includes a compound containing Pb.

6. A liquid discharge apparatus, as defined in claim 1, wherein a crystal grain diameter control layer for controlling the average crystal grain diameter of the edge portion of the piezoelectric body so that the average crystal grain diameter of the edge portion becomes smaller than that of the main portion is formed as the base layer of the edge portion of the piezoelectric body.

7. A liquid discharge apparatus, as defined in claim 6, wherein the crystal grain diameter control layer is one of an amorphous layer and a random polycrystalline layer.

8. A liquid discharge apparatus, as defined in claim 6, wherein the crystal grain diameter control layer includes Si and/or a compound containing Si, and wherein the piezoelectric body includes a compound containing Pb.

9. A liquid discharge apparatus, as defined in claim 6, wherein the crystal grain diameter control layer has lower thermal conductivity than the lower electrode.

10. A liquid discharge apparatus, as defined in claim 9, wherein the crystal grain diameter control layer is one of a glass layer and a porous ceramic layer.

11. A liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the Young's modulus of the edge portion is lower than that of the main portion.

12. A liquid discharge apparatus, as defined in claim 11, wherein the edge portion has amorphous structure, and wherein the main portion has polycrystalline structure.

13. A liquid discharge apparatus, as defined in claim 11, wherein the lower electrode is formed by patterning in an area of the piezoelectric body, the area excluding the edge portion.

14. A liquid discharge apparatus, as defined in claim 13, wherein the base layer of the edge portion of the piezoelectric body has one of amorphous structure and random polycrystalline structure.

15. A liquid discharge apparatus, as defined in claim 13, wherein the base layer of the edge portion of the piezoelectric body includes Si and/or a compound containing Si, and wherein the piezoelectric body includes a compound containing Pb.

16. A liquid discharge apparatus, as defined in claim 11, wherein a crystal grain diameter control layer for controlling the average crystal grain diameter of the edge portion of the piezoelectric body so that the average crystal grain diameter of the edge portion becomes smaller than that of the main portion is formed as the base layer of the edge portion of the piezoelectric body.

17. A liquid discharge apparatus, as defined in claim 16, wherein the crystal grain diameter control layer is one of an amorphous layer and a random polycrystalline layer.

18. A liquid discharge apparatus, as defined in claim 16, wherein the crystal grain diameter control layer includes Si and/or a compound containing Si, and wherein the piezoelectric body includes a compound containing Pb.

19. A liquid discharge apparatus, as defined in claim 16, wherein the crystal grain diameter control layer has lower thermal conductivity than the lower electrode.

20. A liquid discharge apparatus, as defined in claim 19, wherein the crystal grain diameter control layer is one of a glass layer and a porous ceramic layer.

21. A liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the average crystal grain diameter of the edge portion is smaller than that of the main portion.

22. A liquid discharge apparatus, as defined in claim 21, wherein the edge portion has amorphous structure, and wherein the main portion has polycrystalline structure.

23. A liquid discharge apparatus, as defined in claim 21, wherein the lower electrode is formed by patterning in an area of the piezoelectric body, the area excluding the edge portion.

24. A liquid discharge apparatus, as defined in claim 23, wherein the base layer of the edge portion of the piezoelectric body has one of amorphous structure and random polycrystalline structure.

25. A liquid discharge apparatus, as defined in claim 23, wherein the base layer of the edge portion of the piezoelectric body includes Si and/or a compound containing Si, and wherein the piezoelectric body includes a compound containing Pb.

26. A liquid discharge apparatus, as defined in claim 21, wherein a crystal grain diameter control layer for controlling the average crystal grain diameter of the edge portion of the piezoelectric body so that the average crystal grain diameter of the edge portion becomes smaller than that of the main portion is formed as the base layer of the edge portion of the piezoelectric body.

27. A liquid discharge apparatus, as defined in claim 26, wherein the crystal grain diameter control layer is one of an amorphous layer and a random polycrystalline layer.

28. A liquid discharge apparatus, as defined in Claim 26, wherein the crystal grain diameter control layer includes Si and/or a compound containing Si, and wherein the piezoelectric body includes a compound containing Pb.

29. A liquid discharge apparatus, as defined in claim 26, wherein the crystal grain diameter control layer has lower thermal conductivity than the lower electrode.

30. A liquid discharge apparatus, as defined in claim 29, wherein the crystal grain diameter control layer is one of a glass layer and a porous ceramic layer.

31. A liquid discharge apparatus comprising:

a liquid storage-discharge member including a liquid storage chamber for storing liquid and a liquid outlet for discharging the liquid from the liquid storage chamber to the outside of the liquid storage chamber;

a vibration plate formed on the liquid storage-discharge member; and a piezoelectric element including a lower electrode, a piezoelectric body and an upper electrode, the lower electrode, the piezoelectric body and the upper electrode being sequentially formed on the vibration plate, wherein the piezoelectric body includes an edge portion including at least a portion of the piezoelectric body, the portion positioned on the outside of the wall position of the liquid storage chamber, and a main portion, which is the remaining portion of the piezoelectric body, and wherein the edge portion and the main portion are formed on different base layers from each other, and wherein the edge portion has composition that can cause the Young's modulus of the edge portion to become lower than that of the main portion.

* * * * *